United States Patent [19]

Bosetto

[11] Patent Number: 4,787,312

[45] Date of Patent: Nov. 29, 1988

[54] VARIABLE UNIT FOR SUPPLYING INK IN AN OFFSET PRINTING MACHINE

[75] Inventor: Enzo Bosetto, Turin, Italy

[73] Assignee: Nebiolo Macchine S.p.A., Turin, Italy

[21] Appl. No.: 881,861

[22] Filed: Jul. 3, 1986

[30] Foreign Application Priority Data

Jul. 4, 1985 [IT] Italy ..... 67617 A/85

[51] Int. Cl.[4] ..... B41F 31/00

[52] U.S. Cl. ..... 101/350; 101/DIG. 6

[58] Field of Search ..... 101/349, 350, 368, 351, 101/352, DIG. 6, 207, 208, 209

[56] References Cited

U.S. PATENT DOCUMENTS

| | | | |
|---|---|---|---|
| Re. 20,458 | 7/1937 | Schlesinger | 101/DIG. 6 X |
| 2,177,261 | 10/1934 | Lembcke | 101/DIG. 6 X |
| 2,248,645 | 7/1941 | Schlesinger | 101/DIG. 6 X |
| 4,129,077 | 12/1978 | Fischer | 101/DIG. 6 X |
| 4,148,256 | 4/1979 | Fischer | 101/DIG. 6 X |
| 4,466,347 | 8/1984 | Difflipp et al. | 101/DIG. 6 X |

*Primary Examiner*—J. Reed Fisher
*Assistant Examiner*—Moshe I. Cohen
*Attorney, Agent, or Firm*—Sughrue, Mion, Zinn, Macpeak, and Seas

[57] ABSTRACT

An ink supply unit for an offset printing machine includes an ink fountain roller and a distributing roller spaced from and rotating faster than the ink fountain roller. A rotatable transfer roller oscillates between a first position in contact with the ink fountain roller and a second position in contact with the distributing roller. A rotatable auxiliary roller is moveable between a first working position spaced from the ink fountain roller and the distributing roller and a second working position in operative ink transfer relation with the ink fountain roller. In the first working position the auxiliary roller interferes with the movement of the transfer roller toward the ink fountain roller to slow the rotation of the transfer roller before contact with the ink fountain roller. In the second working position of the auxiliary roller, the transfer roller is maintained in contact with the auxiliary roller and the distributing roller.

2 Claims, 1 Drawing Sheet

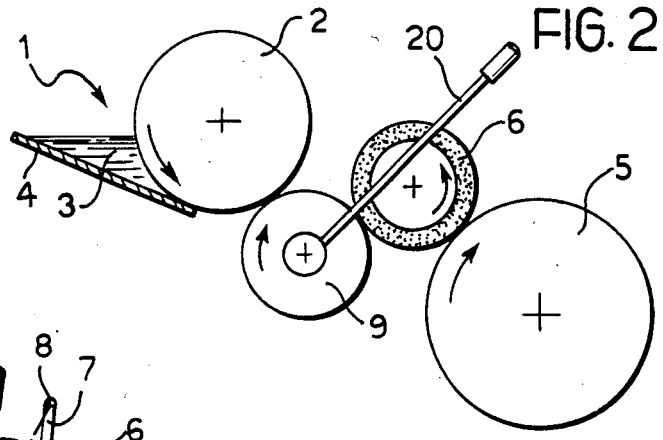
FIG. 2
FIG. 1
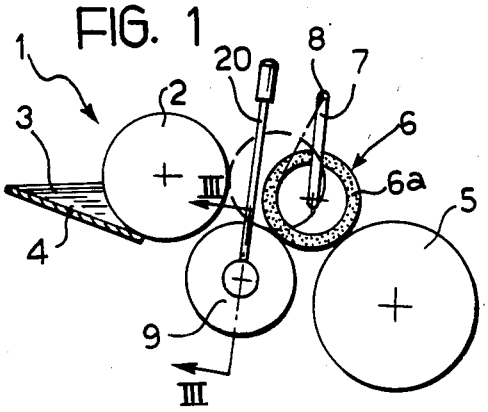
FIG. 3
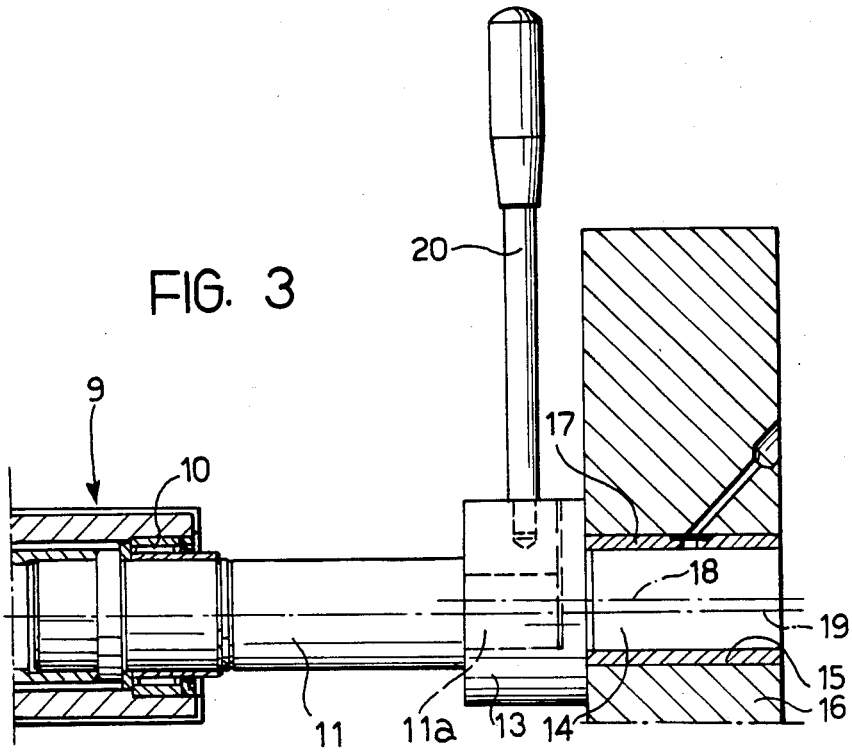

VARIABLE UNIT FOR SUPPLYING INK IN AN OFFSET PRINTING MACHINE

The present invention relates to a unit for supplying ink in an offset printing machine, of the type comprising an ink fountain roller which draws a film of ink from a reservoir, a distributing roller located at a distance from the ink fountain roller and rotating at a higher speed than the speed of rotation of the ink fountain roller, a transfer roller freely rotatably supported by a support structure which can oscillate reciprocatingly between a first position in which the transfer roller is in contact with the ink fountain roller so as to take the film of ink therefrom, and a second position in which the transfer roller is in contact with the distributing roller so as to transfer the film of ink to the latter.

The main disadvantage of units of the known type specified above lies in the fact that the accelerations imparted to the pivotable support structure for the transfer roller increase as the speed of the printing machine increases, resulting in an irregular supply of ink from the ink fountain roller to the transfer roller.

Units are also known for supplying ink in offset printing machines, in which an inking roller is provided in a fixed position immediately adjacent the ink fountain roller and takes a trace of ink from the ink fountain roller and transfers it by means of a further rubber roller to the distributing roller. This system has the disadvantage of requiring adjustment of the distance between the ink fountain roller and the inking roller which may involve rather difficult and laborious operations. Moreover, as the temperature varies, the consequent variation in the viscosity of the ink results in a variation in the quantity of ink which is transferred from the ink fountain roller to the inking roller, whereby a uniform supply of ink is not obtained. Finally, the ink fountain roller is constantly covered with a thicker layer of ink than necessary, due to the very fact that there is no direct contact with the inking roller; consequently, when the machine is stopped, there is a danger of ink transfer from the fountain roller to the blade associated with it and constituting the bottom of the ink reservoir.

The object of the present invention is to provide a unit for supplying ink in an offset printing machine which is able to operate in accordance with either of the two systems mentioned above, while at the same time avoiding the disadvantages of the units made up to now.

In order to achieve this object, the invention provides a unit for supplying ink in an offset printing machine of the type specified at the beginning of the present specification, characterized in that it further includes a freely-rotatable auxiliary roller which is movable between a first working position spaced from the ink fountain roller and the distributing roller and corresponding to a first operating mode of the unit, and a second working position in contact with or immediately adjacent the ink fountain roller and corresponding to a second operating mode of the unit, so that, when the auxiliary roller is in its first working position,it interferes with the movement of the transfer roller towards the ink fountain roller to slow its rotation before its contact with the ink fountain roller, while, when the auxiliary roller is in its second working position, the transfer roller is maintained in a fixed position in contact with both the auxiliary roller and the distributing roller to transfer the film of ink from the auxiliary roller to the distributing roller.

When the auxiliary roller is in the first working position, the unit according to the invention is able to operate as a conventional unit with intermittent transfer of the ink from the ink fountain roller to the distributing roller by the reciprocating oscillation of the transfer roller between the two rollers. When the auxiliary roller is in the second working position, however, the unit of the invention is able to operate according to the conventional "skimming" system, that is, with the inking roller immediately adjacent the ink fountain roller. In the case of the present invention, in the second mode of operation, the function of the inking roller is fulfilled by the auxiliary roller which, in this case, may also be disposed in direct contact with the ink fountain roller.

When the unit according to the invention is used to transfer ink intermittently (the first operating mode), the auxiliary roller, as specified above, serves to slow the rotation of the transfer roller before it comes into contact with the ink fountain roller. The disadvantages of the prior art mentioned above are therefore avoided.

When the unit according to the invention is used in the second operating mode, however, the transfer roller, which is held in a fixed position, is used as a "bridge" between the auxiliary roller and the distributing roller. In this case, the particular arrangement adopted by the rollers enables the uniformity of the ink supply to be improved by virtue of the fact that the length of the path which the ink must travel in the form of a relatively thick film, that is, before its introduction into the distributing unit, is less than in the known solutions. This also avoids disadvantages resulting from dripping of ink when the machine is stopped.

Further characteristics and advantages of the present invention will become apparent from the description which follows with reference to the appended drawings, provided purely by way of non-limiting example, in which:

FIG. 1 is a schematic view of an ink supply unit according to the invention in a first operating condition, FIG. 2 is a schematic view of the unit of FIG. 1 in a second operating condition, and FIG. 3 is a partially sectioned view taken on the line III—III of FIG. 1, on an enlarged scale.

In the drawings, an ink supply unit in an offset printing machine is generally indicated 1. The unit 1 includes an ink fountain roller 2 rotated at a relatively slow speed and arranged to draw a film of ink form an ink reservoir 3 the bottom of which is defined by an inclined blade having its lower edge in contact with the ink fountain roller 2. At a certain distance from the ink fountain roller 2 there is a distributing roller 5 which constitutes the first of a series of rollers of a distributing unit, of known type, for reducing the thickness of the ink layer which is to be supplied to the plate cylinder of the printing machine.

A transfer roller, indicated 6, has a rubber cover **6*a* and is freely-rotatably supported by a pair of levers 7 pivotable on a fixed support structure (not visible in FIGS. 1 and 2) about a horizontal axis 8**.

FIG. 1 illustrates the unit of the invention in a first operating condition in which the levers 7 are made to reciprocate about the pivot axis 8 so as to carry the transfer roller 6 alternately into a first working position (illustrated in broken outline in FIG. 1) in which it is in contact with the ink fountain roller 2 and a second working position (illustrated in continuous outline) in which it is in contact with the distributing roller 5. The latter is rotated at a higher speed than the speed of rotation of the ink fountain roller 2. When the transfer roller 6 comes into contact with the distributing roller 5, the layer of ink previously taken up by the ink fountain roller 2 is transferred to it and, as a result of the contact with the distributing roller 5, assumes a peripheral velocity corresponding to that of the distributing roller 5.

In order to reduce sliding between the ink fountain roller 2 and the transfer roller 6 when the latter rotates in contact with the ink fountain roller, the unit of the invention provides an auxiliary roller 9 which is freely rotatable and movable between a first working position, illustrated in FIG. 1, and a second working position, illustrated in FIG. 2.

The first working position of the auxiliary roller 9, illustrated in FIG. 1, corresponds to the operating condition of the unit described above. In this case, the roller 9 is in a position such as to interfere with the path of the transfer roller 6 when it moves from the distrubiting roller 5 towards the ink fountain roller 2. Hence, before the transfer roller 6 comes into contact with the ink fountain roller 2, the speed of rotation which it has acquired as a result of contact with the distributing roller 5 has been reduced by contact with the auxiliary roller 9. Thus, the disadvantages of an irregular supply of ink which are encountered with known systems with intermittent ink transfer are avoided.

When the auxiliary roller 9 is disposed in its second working position (see FIG. 2), the unit of the invention is arranged for use in its second made of operation.

In this case, the transfer roller 6 is kept in a fixed position in which it constitutes a "bridge" between the auxiliary roller 9 and the distributing roller 5, while the auxiliary roller 9 is kept in contact with, or immediately adjacent, the ink fountain roller 2.

As mentioned in the introduction to the present specification, in this case, the path of the ink in correspondence with the rubber roller 6 is relatively small compared with known solutions (in the drawings, the arrows indicate the sense of rotation of the rollers during operation of the machine). This avoids the risk of dripping when the machine is stopped, which is characteristic of known systems. Moreover, the roller 6 may be moved slightly away from the rollers 9, 5 by upward movement so as to allow an operator to determine the quantity of ink transferred at any time.

FIG. 3 illustrates a detail of the support structure for the auxiliary roller 9. With reference to this Figure, the roller 9 is supported at each end by a roller bearing 10 on one end of a cylindrical pin 11 the opposite end of which, indicated 11*a*, is fixed in a seat of a support 13. The support 13 is provided in its turn with a pin 14 which is rotatably supported in a hole 15 in a fixed support structure 16 with the interposition of a bush 17. The axes of the pins 14, 11, indicated 18, 19 respectively, are not coincident whereby a rotation of the support 13 relative to the fixed support structure 16 causes a variation in the position of the roller 9. More precisely, the support 13 has an operating lever 20 which enables the angular position of the support 13 to be varied relative to the fixed support structure 16 so as to move the auxiliary roller 9 between its first working position and its second working position.

What I claim is:

1. Unit for supplying ink in an offset printing machine, comprising an ink fountain roller (2) which draws a film of ink from a reservoir (3), a distributing roller (5) located at a distance from the ink fountain roller (2) and rotating at a higher speed than the speed of rotation of the ink fountain roller (2), a transfer roller (6) freely rotatably supported by a support structure (7) which can oscillate reciprocatingly between a first position in which the transfer roller (6) is in contact with the ink fountain roller (2) so as to take the film of ink therefrom, and a second position in which the transfer roller (6) is in contact with the distributing roller (5) so as to transfer the film of ink of the latter, characterized in that the unit further includes a freely rotatable auxiliary roller (9) which is moveable between a first working position spaced from the ink fountain roller (2) and the distributing roller (5) and corresponding to a first operating mode of the unit, and a second working position in operative ink transfer relation with the ink fountain roller (2) and corresponding to a second operating mode of the unit, so that, when the auxiliary roller (9) is in its first working position, it interferes with the movement of the transfer roller towards the ink fountain roller (2) so as to slow its rotation before its contact with the ink fountain roller (2), while, when the auxiliary roller (9) is in its second working position, the transfer roller (6) is maintained in a fixed position in contact with both the auxiliary roller (9) and the distributing roller (5) to transfer the film of ink from the auxiliary roller to the distributing roller.

2. Supply unit according to claim 1, characterised in that the unit includes a fixed support structure (16), a support (11,13) on which the auxiliary roller (9) is freely rotatably mounted, the support (11,13) in its turn being rotatable on the support structure (16) about an axis (18) offset relative to the axis (19) of the auxiliary roller (9), and means (20) for adjusting the angular position of the support relative to the support structure.

* * * * *